US005865157A

United States Patent [19]

Romanelli et al.

[11] Patent Number: 5,865,157

[45] Date of Patent: Feb. 2, 1999

[54] CAM ACTUATED FUEL DISTRIBUTOR

[75] Inventors: Patrick Romanelli; Robert James Romanelli, both of Harrington, N.J.

[73] Assignee: Pacer Industries, Inc., Pensacola, Fla.

[21] Appl. No.: 923,473

[22] Filed: Sep. 4, 1997

[51] Int. Cl.[6] ..... F02M 39/00

[52] U.S. Cl. ..... 123/451; 123/462; 137/871

[58] Field of Search ..... 123/457, 462, 123/451, 369; 137/862, 871, 883

[56] References Cited

U.S. PATENT DOCUMENTS

| | | | |
|---|---|---|---|
| 2,521,119 | 9/1950 | Green | 123/451 |
| 2,827,030 | 3/1958 | Strumbos | 123/451 |
| 3,870,025 | 3/1975 | Anderson et al. . | |
| 4,138,979 | 2/1979 | Taplin . | |
| 4,168,688 | 9/1979 | Bart . | |
| 4,224,093 | 9/1980 | Mowbray | 123/462 |
| 4,469,070 | 9/1984 | Rassey | 123/462 |
| 4,617,898 | 10/1986 | Gayler | 123/460 |
| 4,909,220 | 3/1990 | Field et al. | 123/468 |
| 5,035,221 | 7/1991 | Martin | 123/451 |
| 5,341,785 | 8/1994 | Meaney . | |

*Primary Examiner*—Thomas N. Moulis

*Attorney, Agent, or Firm*—St. Onge Steward Johnston & Reens LLC

[57] ABSTRACT

A fuel distributor for delivering fuel under pressure to cylinders of an engine. The distributor includes a housing, an inlet for delivering fuel under pressure to the housing, a plurality of outlets in the housing and a valve assembly mounted in each outlet. Each valve assembly is for connection to a fuel injector mounted in a cylinder of the engine, and each assembly includes a passage for delivering fuel under pressure from the housing, a plunger positioned in the passage, and a valve spring biasing the plunger to one of a passage open position and a passage closed position. The fuel distributor also includes a cam for moving the plungers against the valve springs, whereby movement of the cam controls fuel flow to the cylinders.

18 Claims, 4 Drawing Sheets

CAM ACTUATED FUEL DISTRIBUTOR

FIELD OF THE INVENTION

The present invention relates to an internal combustion engine and, more particularly, to a fuel injection system for use with an internal combustion engine. Even more particularly, the invention relates to a cam actuated fuel distributor for use as part of a fuel injection system.

BACKGROUND OF THE INVENTION

In conventional fuel delivery systems for internal combustion engines, a constant-delivery fuel pump supplies fuel under pressure from a tank to a fuel rail positioned on the engine. A plurality of fuel injectors are mounted between the fuel rail and the engine intake manifold, with the injector nozzles being positioned adjacent to the fuel/air intake ports of the individual engine cylinders. The fuel injectors are individually electromagnetically actuated by an engine control unit as a function of operating conditions and parameters at the engine.

A major cost associated with fuel delivery systems of the described character lies in the individual fuel injectors, and in the complexity of electrical conductors that connect the fuel injectors to the engine control unit. The fuel injectors are subject to wear, and may eventually feed differing quantities of fuel to the cylinders even when actuated for nominally identical time durations, thus resulting in less than optimum engine operation. Furthermore, conventional fuel injectors present additional difficulties when employed in conjunction with so-called alternative fuels. Fuels of this character have lower lubricity than conventional gasoline fuels, increasing wear at the individual injectors. The injector wear parts may be constructed of stainless steel, for example, which reduces wear but greatly increases cost. Moreover, because of lower energy content of alcohol-based alternative fuels, for example, the injectors must have a larger fuel opening and/or remain open longer than would otherwise be desirable in operation with gasoline. Thus, conventional fuel injectors are not well suited for use in association with engines intended for operation with alternative fuels having different potential energy contents.

U.S. Pat. No. 5,341,785 to Meaney discloses a fuel delivery system for internal combustion engines including a fuel-metering distributor. The Meaney system eliminates conventional electromagnetic fuel injectors, thereby achieving reduced cost, reduced complexity, reduced wear and increased operating life. The Meaney system also automatically delivers identical quantities of fuel to all of the engine cylinders, and automatically controls fuel quantity over a wide flow range with multiple fuel types without requiring adjustment by an operator or engine technician. The fuel-metering distributor disclosed in Meaney includes a fuel cavity and apertures in a sidewall of the fuel cavity coupled to associated individual fuel lines. A piston is slidingly disposed in the fuel cavity for opening the individual apertures as a function of position of the piston within the cavity, and a linear electromagnetic actuator is coupled to the piston for controlling the position of the piston within the cavity.

What is desired, however, is a fuel distributor wherein the fuel flow through each aperture, or fuel outlet, can be individually adjusted to optimize performance.

SUMMARY OF THE INVENTION

A general object, therefore, of the present invention is to provide an improved fuel injection system for use as part of an internal combustion engine that improves engine performance and fuel economy, and reduces emissions.

A more particular object of the present invention is to provide an improved fuel distributor for use as part of a fuel injection system of an internal combustion engine.

Another object of the present invention is to provide a fuel distributor that eliminates the need for conventional electromagnetic fuel injectors, thereby achieving reduced cost, reduced complexity, reduced wear and increased operating life.

An additional object of the present invention is to provide a fuel distributor that automatically delivers identical quantities of fuel to all of the engine cylinders, and automatically controls fuel quantity over a wide flow range with multiple fuel types without requiring adjustment by an operator or engine technician.

A further object of the present invention is to provide a fuel distributor wherein fuel flow through each fuel outlet of the fuel distributor can be individually adjusted to optimize performance.

These and other objects of the present invention are achieved by a fuel distributor for delivering fuel under pressure to cylinders of an engine. The distributor includes a housing, an inlet for delivering fuel under pressure to the housing, a plurality of outlets in the housing, and a valve assembly mounted in each outlet. Each valve assembly is for connection to a fuel injector mounted in a cylinder of the engine, and each assembly includes a passage for delivering fuel under pressure from the housing, a plunger positioned in the passage, and a valve spring biasing the plunger to one of a passage open position and a passage closed position. The fuel distributor also includes a cam for moving the plungers against the valve springs, whereby movement of the cam controls fuel flow to the cylinders.

According to one aspect of the present invention, the fuel distributor also includes an actuator controlling movement of the cam.

According to another aspect of the present invention, the distributor includes a return spring biasing the cam so that the cam moves the plungers in opposition to the valve springs to preferably keep the plungers in the passage closed position until the shaft is moved.

According to a further aspect of the present invention, the fuel distributor includes an idler stop limiting movement of the cam by the return spring to always provide at least enough fuel flow to idle the engine whenever the engine is on.

The present invention also provides a fuel injection system including the fuel distributor described above. The system further includes at least one fuel injector connected to each valve assembly and mountable in a cylinder of the engine, and a pressurized fuel supply connected to the fuel inlet of the distributor.

The invention and its particular features and advantages will become more apparent from the following detailed description considered with reference to the accompanying drawings.

DETAILED DESCRIPTION OF THE INVENTION

Figure 1:
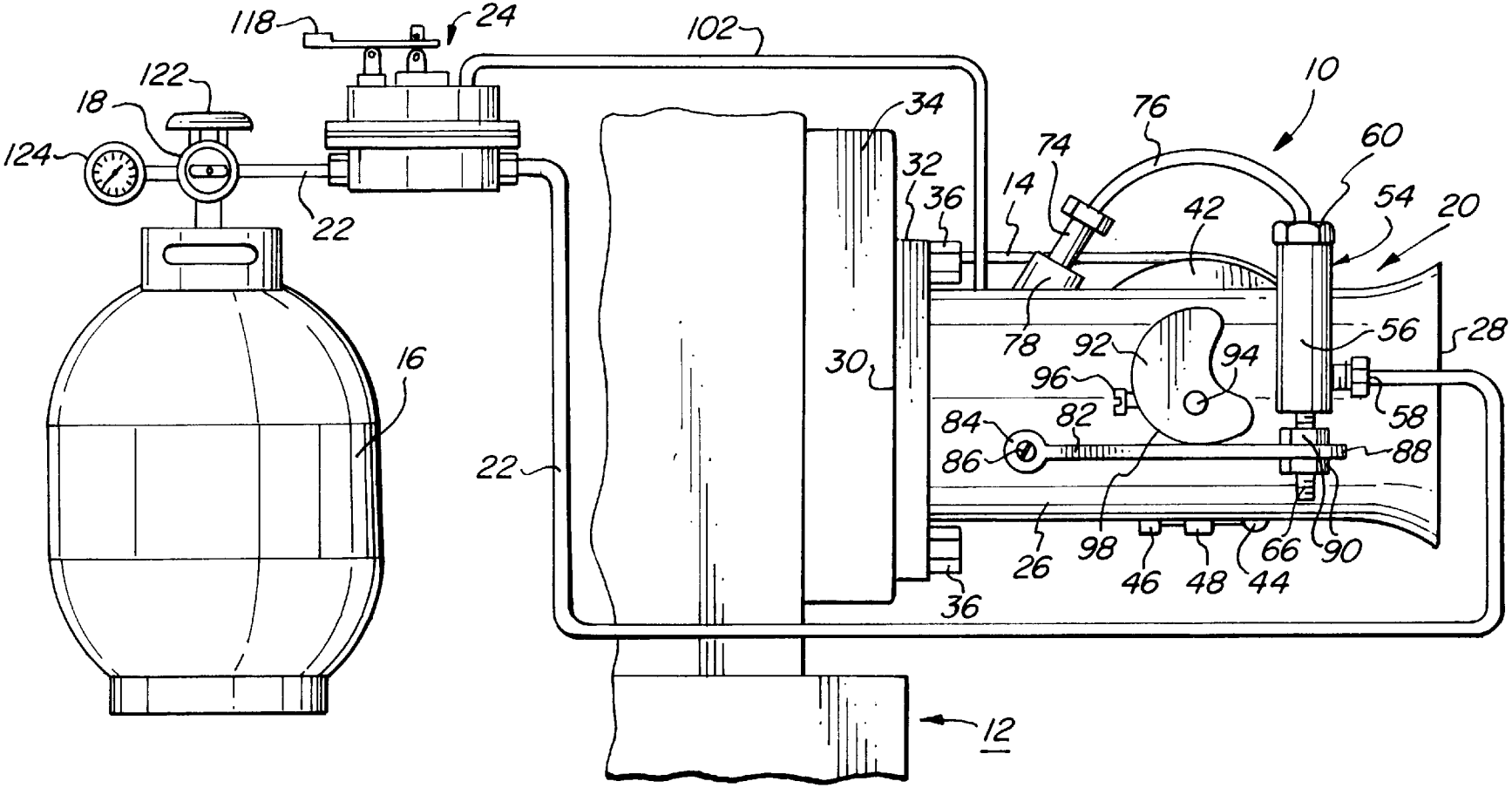
FIG. 1 is a front isometric view of a cam actuated fuel distributor according to the present invention illustrated connected to schematic representations of an internal combustion engine and a fuel injection system.

Referring first to FIG. 1, the present invention provides a fuel injection system 10 including a cam actuated fuel distributor 12 for use with an internal combustion engine 14 having, in the embodiment shown, four cylinders 16 (only one is shown), with each containing a piston 18. The fuel distributor 12 is controlled by an actuator 20, which is in turn controlled by a throttle 22 of the engine 14. In general, the fuel distributor 12 is filled with pressurized fuel from a pressurized fuel supply 24 and equally distributes the fuel to mechanical fuel injectors 26 mounted in the cylinders 16 of the engine 14. The present invention, accordingly, eliminates conventional electromagnetic fuel injectors, thereby achieving reduced cost, reduced complexity, reduced wear and increased operating life. The present invention also automatically delivers identical quantities of fuel to all of the engine cylinders 16 and automatically controls fuel quantity over a wide flow range with multiple fuel types without requiring adjustment by an operator or engine technician. The fuel distributor 12 is for use with gasoline or alternative fuels such as gasohol or natural gas, for example.

Figure 2:
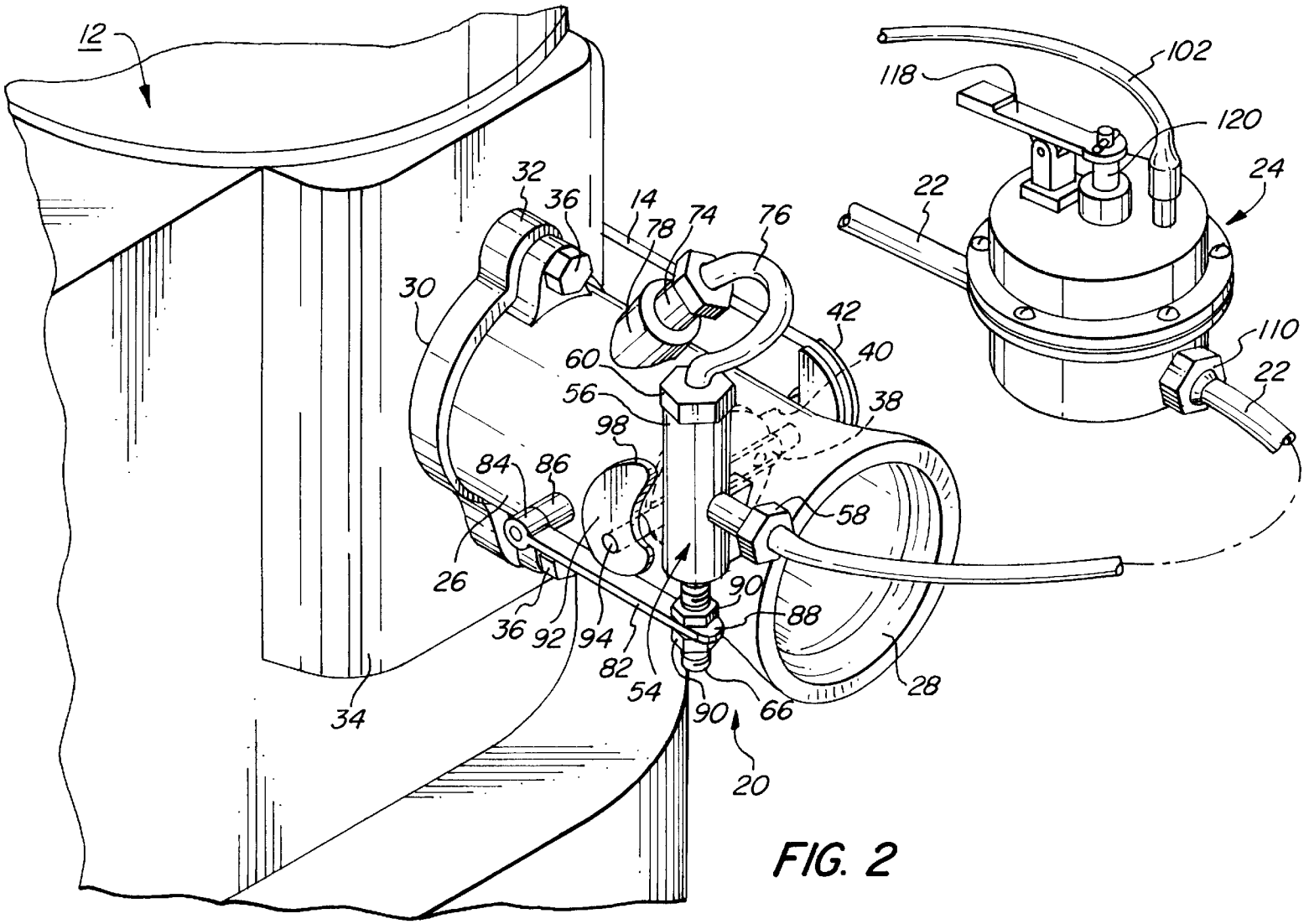
FIG. 2 is a side elevation view, partially in section, of the fuel distributor of FIG. 1.

As also shown in FIG. 2, the cam actuated fuel distributor 12 includes a cylindrical housing 28 having a tubular sidewall 30 closed, in a liquid-tight manner, at opposite ends by a baseplate 32 and a coverplate 34. The baseplate 32 and coverplate 34 can be secured to the sidewall 30 by bolts 36, for example, and the sidewall 30, baseplate 32 and coverplate 34 cooperate to define a fuel cavity for containing pressurized fuel during operation of the engine 14. A threaded fuel inlet 40 and four threaded fuel outlets 42 are defined by the sidewall 30, with each of the fuel outlets equally spaced from the coverplate 34. It should be noted that the distributor 12 can have more or less than four fuel outlets 42 depending upon the number of cylinders 16 in the engine 14 and the number of fuel injectors 26 in each cylinder.

Figure 4:
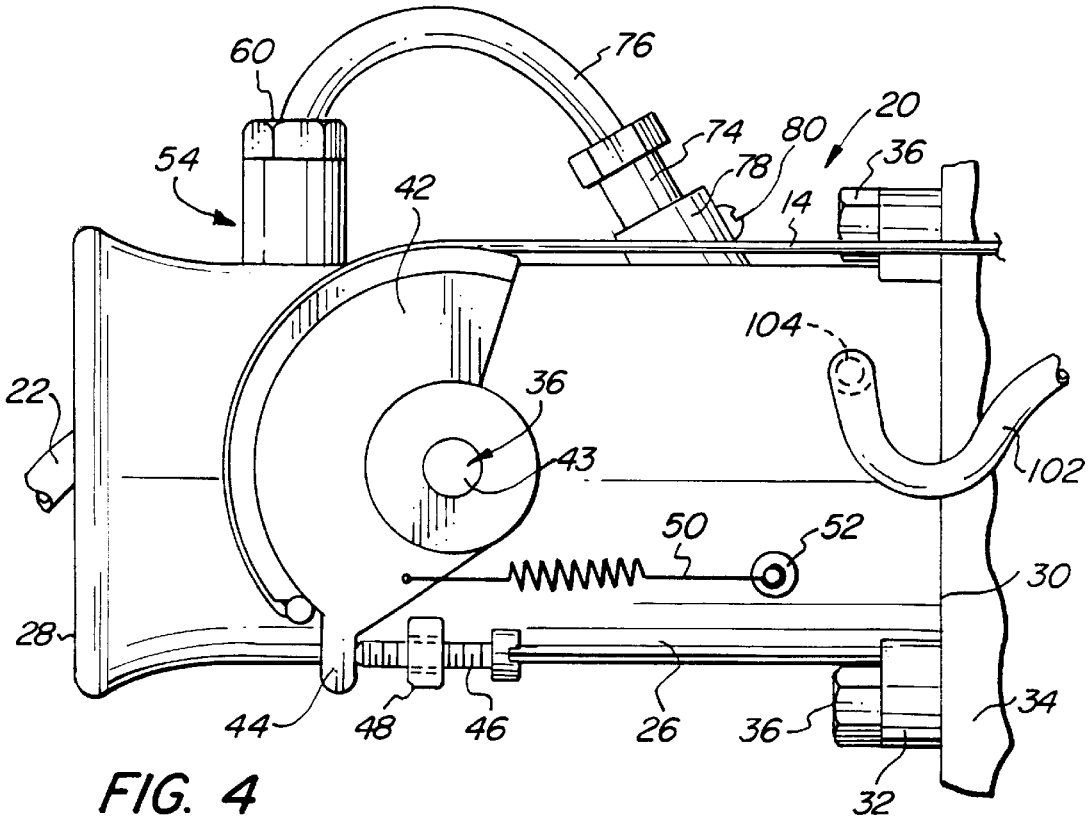
FIG. 4 is an exploded side elevation view, partially in section, of a valve assembly of the fuel distributor of FIG. 1.

Valve assemblies 44, which are shown in greater detail in FIG. 4, are mounted in each fuel outlet 42, normal to the sidewall 30. The assemblies 44 include a threaded sleeve 46, which is secured in the fuel outlet 42 with a locking nut 48, whereby the position of the sleeve 46, and in turn the valve assembly, within the fuel outlet can be adjusted with the locking nut. A plunger 50 is secured within the sleeve 46 with a plunger seat 52 and an endcap 54, which is threaded onto the sleeve 46. The plunger 50 includes a rounded contact end 56, which extends into the fuel cavity 38 through a bore 58 in the sleeve 46, which is surrounded by fuel ports 60. The plunger 50 also has a collar 62 defining fuel ports 64, and a tapered end 66 which closes a fuel passage 68 through the plunger seat 52. A valve spring 69 is positioned between the collar 62 of the plunger 50 and the plunger seat 52 to normally bias the plunger into the fuel cavity 38 to a passage open position wherein the fuel passage 68 through the plunger seat is opened.

Figure 3:
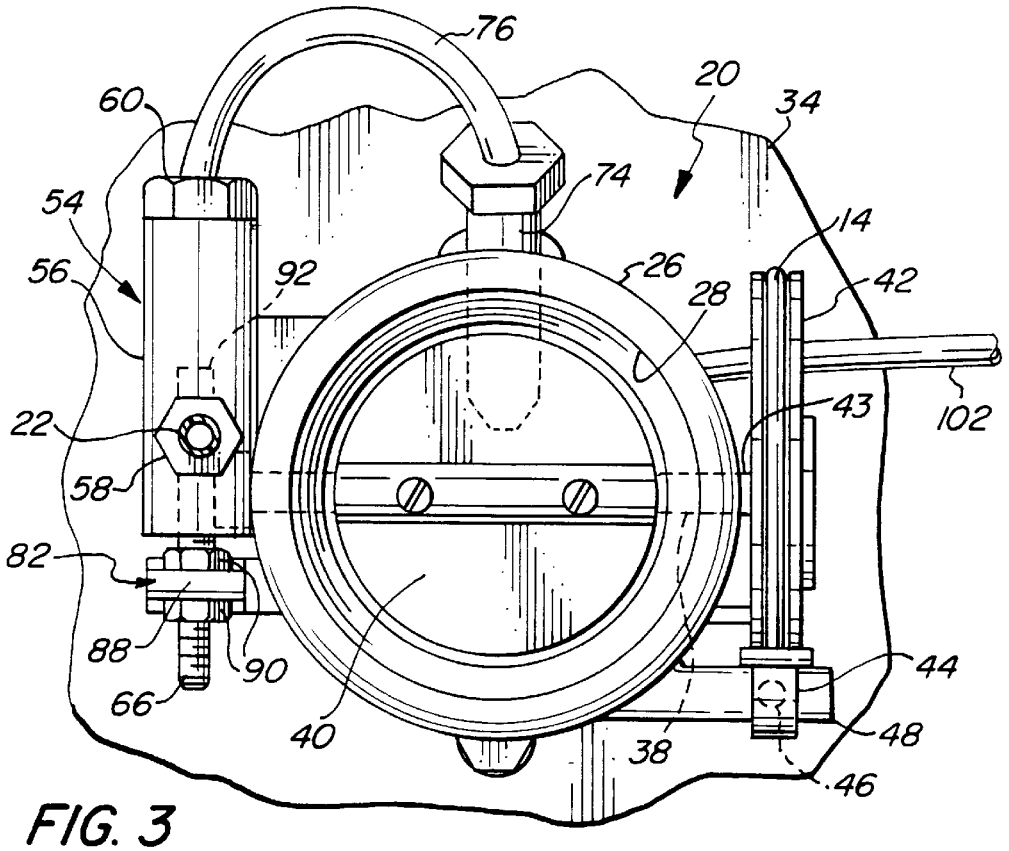
FIG. 3 is a front isometric view of a cam of the fuel distributor of FIG. 1.

A shaft 70 extends through the coverplate 34 coaxially with the tubular sidewall 30, and has a first end 72 extending out of the fuel cavity 38 and a second end 74 received in a bore 76 defined in a boss 78 of the baseplate 32. The shaft 70 is moveable in an axial direction. As also shown in FIG. 3, a cam 80, which is generally conical in shape, is co-axially secured on the shaft 70 within the fuel cavity 38 so that a larger diameter end 82 of the cam 80 is nearer the coverplate 34, a smaller diameter end 84 is nearer the baseplate 32, and a side or cam surface 86 of the cam 80 contacts the contact end 56 of each of the inwardly biased plungers 50. A return spring 88 is positioned on the shaft 70 between the coverplate 34 and the cam 80, biasing the cam 80 and shaft 70 towards the baseplate 32 so that the cam 80 normally presses the plungers 50 outwardly to passage closed positions wherein the fuel passages 68 of each valve assembly 44 are closed. An idler screw 90 is adjustably secured in the bore 76 in the baseplate 32 with a locking nut 92 to set the maximum axial movement of the shaft 70 towards the baseplate to provide an idle or minimum amount of fuel flow through the valve assemblies 44. Holes 94 in the boss 78 prevent fuel lock between the shaft 70 and the idler screw 90.

A lever arm 96 has a pivot point 98 between a shaft side 100 and an actuator side 101 pivotally mounted on a post 99 extending from the coverplate 34 opposite the fuel cavity 38. The cam side 100 of the lever arm 96 is pivotally secured to the first end 72 of the shaft 70.

In addition to the cam actuated fuel distributor 12, the fuel injection system 10 includes a fuel inlet line 102 attached to the fuel inlet 40 of the distributor 12 with a threaded connector 104. The fuel inlet line 102 provides pressurized fuel from the pressurized fuel source 24, which can include a constant-delivery fuel pump for transferring fuel from a fuel tank of the vehicle. In addition, a pressure regulator can be coupled to the fuel distributor 12 for returning excess fuel to the fuel tank and maintaining a substantially constant pressure of fuel within the distributor. Alternatively, an engine control unit (ECU) can control a variable-delivery fuel pump by monitoring the pressure within the distributor 12.

The fuel injection system 10 also includes at least one fuel injector line 106 connecting each valve assembly 44 to a fuel injector 26 mounted in a cylinder of the engine 14. The fuel injector lines 106 are connected to the endcaps 54 of the valve assemblies 44 and to the fuel injectors 26 with threaded connectors 110. It should be noted that the endcaps 54 of the valve assemblies 44 could alternatively include T-fittings for connection to two fuel injector lines 106. The fuel injectors 26 are preferably conventional poppet-type injectors, which open in response to pressure of fuel in the fuel injector line 106, and close when there is no pressure in the line, thereby preventing backflow. The fuel injectors 26 atomize, or provide a fine spray of the fuel into the cylinders 16 of the engine 14. The atomized fuel is then ignited by a glow plug or spark plug 118 in the cylinder 16. The positions of the fuel injectors 26 within the cylinder can be adjusted with locking nuts 120 to optimize performance. It should be noted that the poppet-type injectors 26 can be replaced with other conventional mechanical means or devices for atomizing fuel delivery to the individual cylinders 16.

The linear actuator 20, ultimately controlled by the throttle 22, has a piston rod 122 pivotally connected to the actuator side 101 of the lever arm 96, whereby opening the throttle 22 causes the piston rod of the linear actuator to push the actuator side of the lever arm towards the coverplate 34, so that the cam side 100 of the lever arm pivots about the pivot point 98 to pull the shaft 70 out of the fuel cavity 38. The cam 80 in turn moves toward the coverplate 34, compressing the return spring 88, with the narrowing, conical cam surface 86 of the cam allowing the plungers 50 to be biased inwardly, opening the fuel passages 68 in the valve assemblies 44 and allowing pressurized fuel to be delivered to the fuel injectors 26. Upon closing the throttle 22, the linear actuator 20 is powered down and the return spring 88 forces the cam 80 and shaft 70 towards the baseplate 32, biasing the plungers 50 outwardly to shut off or idle the fuel flow to the fuel injectors 26. As discussed above, each of the valve assemblies 44 can be manually calibrated with the locking nuts 48 to equalize flow.

The linear actuator 20 is an electromagnetic linear actuator having coils (not shown) receiving control signals from an electronic control unit (ECU) 126 of the engine 14 for controlling the position of the piston rod 122. The ECU 126 provides the control signal after monitoring the position of the throttle 22, and various conditions of the engine 14 as is known in the art. It should be noted that the linear actuator 20 can be replaced by a stepper motor, or by an electric motor and screw/rack arrangement. In addition, the present invention covers an embodiment of the distributor 12, wherein the lever arm 96 and post 99 are eliminated and a custom linear actuator 20 without a piston rod 122 receives the shaft 70 within its coils and thereby directly controls the shaft. The lever arm 96 and post arrangement 99, however, allows the distributor 12 to be used with stock linear actuators, thereby reducing costs.

Figure 5:
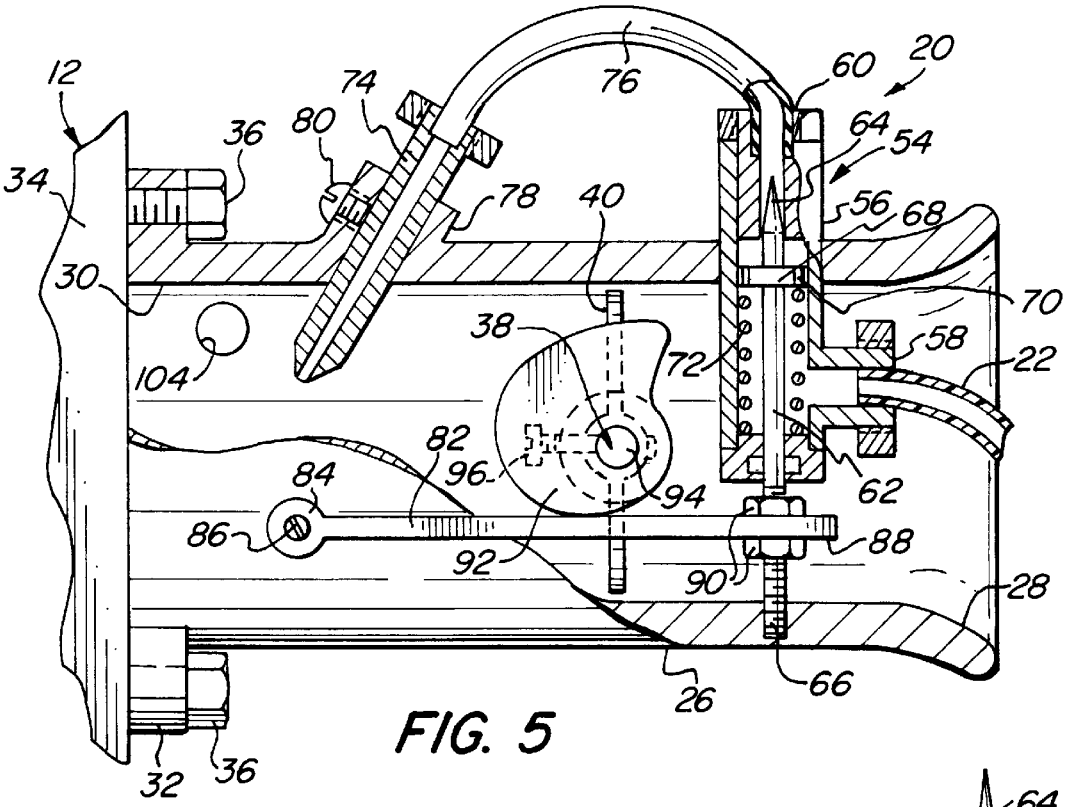
FIG. 5 is a flow diagram illustrating operation of the fuel distributor of FIG. 1.
Figure 6:
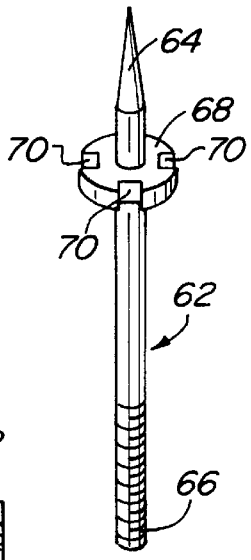
Figure 7:
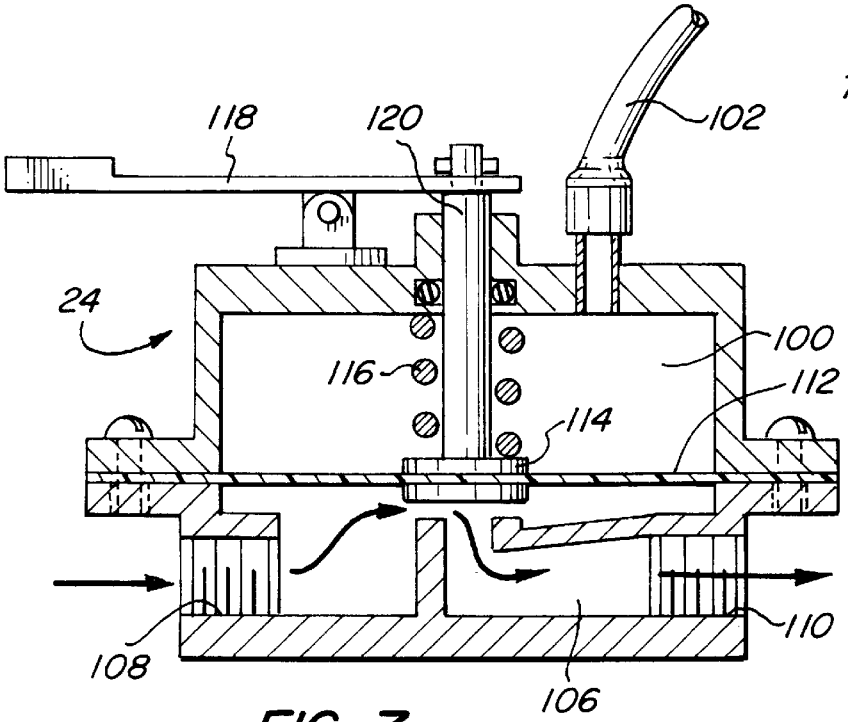

The fuel injection system 10 described above operates according to a method 140 of providing fuel to the cylinders 16 of the internal combustion engine 14 illustrated in the flow diagram of FIG. 5. The method 140 begins at box 142 where the housing 28 having the moveable cam 80 positioned therein is provided. The outlets 42 in the housing are connected to the cylinders 16 of the engine at box 144, and the valve assemblies 44 are mounted within each outlet at box 146. At box 148, the plungers 50 within each passage 68 are biased against the cam 80, at box 150, the cam is moved so that the plungers close the passages, and, at box 152, the housing is filled with pressurized fuel. Thereafter, moving the cam 80 so that the plungers 50 open the passages 68, at box 154, provides pressurized fuel to the cylinders.

It should be noted that although the plungers 50 are shown biased inwardly to a passage open position, and the cam 80 is normally biased to push the plungers outwardly to a passage closed position, the plungers could alternatively be biased inwardly to passage closed positions and the cam could normally be biased to allow the plungers inwardly to the passage closed position. This could be done by providing a valve assembly having structure wherein the plungers 50 are biased inwardly to a passage closed position. Such a valve assembly could be provided by a person skilled in the field of fuel injectors. The cam 80 could then be positioned on the shaft so that its larger diameter end 82 is nearer to the baseplate 32, or the return spring 88 could be positioned between the baseplate and the smaller diameter end 84 so that the cam would normally allow the plungers 50 to be biased inwardly to the passage closed position.

In addition, although the cam 80 is shown with a conical cam surface 86 which provides a linear increase or decrease in fuel flow, the cam could alternatively be provided with a cam surface having other shapes, such as convex cam surface for example, for providing a nonlinear response. Furthermore, it is not beyond the scope of the invention to provide a cam actuated fuel distributor wherein the shaft rotates (instead of moving axially) and has an appropriate cam for moving the plungers of the valve assemblies between passage open and closed positions as the shaft is rotated.

Although the invention has been described with reference to a particular arrangement of parts, features and the like, these are not intended to exhaust all possible arrangements or features, and indeed many other modifications and variations will be ascertainable to those of skill in the art.

What is claimed is:

1. An apparatus for distributing fuel comprising:

a housing;

an inlet for delivering fuel under pressure to the housing;

a plurality of outlets in the housing;

a valve assembly mounted in each outlet and including, a passage for delivering fuel under pressure from the housing, a plunger positioned in the passage, and a valve spring biasing the plunger to one of a passage open position and a passage closed position; and a cam for moving the plungers against the valve springs.

2. An apparatus according to claim 1 wherein the valve springs bias the plungers to the passage open position.

3. An apparatus according to claim 2 further comprising a return spring biasing the cam so that the cam moves the plungers in opposition to the valve springs, whereby moving the cam to overcome the return spring will allow the valve springs to bias the plungers to the passage open position.

4. An apparatus according to claim 3 further comprising an idler stop limiting movement of the cam by the return spring.

5. An apparatus according to claim 1 wherein the valve springs bias the plungers to the closed position.

6. An apparatus according to claim 5 further comprising a return spring biasing the cam so that the cam allows the valve springs to bias the plungers to the closed position, whereby moving the cam to overcome the return spring moves the plungers in opposition to the valve springs to the passage open position.

7. An apparatus according to claim 6 further comprising an idler stop limiting movement of the cam by the return spring.

8. An apparatus according to claim 1 further comprising a return spring biasing the cam to move the plungers to the passage closed position, so that movement of the cam in opposition to the return spring moves the plungers to the passage open position.

9. An apparatus according to claim 8 further comprising an idler stop limiting movement of the cam by the return spring.

10. An apparatus according to claim 1 further comprising an actuator for moving the cam.

11. A fuel injection system including an apparatus according to claim 1 and further comprising:

at least one fuel injector connected to each outlet; and a pressurized fuel supply connected to the inlet.

12. An apparatus for distributing fuel comprising:

a housing;

an inlet for delivering fuel under pressure to the housing;

a moveable shaft having a cam surface positioned within the housing; and a valve assembly mounted to the housing and including, a passage for delivering fuel under pressure from the housing, a plunger positioned in the passage, the plunger moveable between a passage open position and a passage closed position, and a valve spring biasing the plunger against the cam surface of the shaft.

13. An apparatus according to claim 12 further comprising a return spring biasing the shaft to move the plunger to the passage closed position, so that movement of the shaft in opposition to the return spring moves the plunger to the passage open position.

14. An apparatus according to claim 13 further comprising an idler stop limiting movement of the shaft by the return spring.

15. An apparatus according to claim 12 further comprising an actuator for moving the shaft.

16. An apparatus according to claim 12 wherein the movement of the shaft is axial movement.

17. A fuel injection system including an apparatus according to claim 12 and further comprising:

at least one fuel injector connected to the outlet; and a pressurized fuel supply connected to the inlet.

18. A method of delivering fuel to cylinders of a internal combustion engine, comprising the steps of:

providing a housing having a moveable cam positioned therein;

connecting outlets in the housing to cylinders of the engine;

mounting a valve assembly within each outlet, the valve assemblies each having a passage for delivering fuel from the housing;

biasing plungers within each passage against the cam;

moving the cam so that the plungers close the passages;

filling the housing with pressurized fuel; and moving the cam so that the plungers open the passages.

* * * * *